United States Patent [19]

Weingarth

[11] 4,207,608

[45] Jun. 10, 1980

[54] ELEMENT FOR CONDUCTING LIGHT TO AN OUTSIDE SURFACE OF FURNISHING ARTICLE

[76] Inventor: Frederick C. Weingarth, P.O. Box 2341, Ft. Lauderdale, Fla. 33303

[21] Appl. No.: 816,341

[22] Filed: Jul. 18, 1977

[51] Int. Cl.[2] ..... F21S 1/12

[52] U.S. Cl. ..... 362/410; 362/414; 362/367

[58] Field of Search ..... 340/62; 362/410, 356, 362/360, 367, 414, 434, 317, 346

[56] References Cited

U.S. PATENT DOCUMENTS

| | | | |
|---|---|---|---|
| 2,466,176 | 4/1949 | Kunisch | 362/414 |
| 2,521,355 | 9/1950 | Ford | 362/414 |
| 3,408,501 | 10/1968 | Thompson | 362/277 |
| 3,949,350 | 4/1976 | Smith | 362/86 |

*Primary Examiner*—Benjamin R. Padgett
*Assistant Examiner*—J. L. Barr
*Attorney, Agent, or Firm*—Gary M. Polumbus

[57] ABSTRACT

A light conductive element comprising a portion of the outside visible surface of an article of furniture deflects light from the interior of the article to the exterior of the article. Deflecting the light can be achieved by light reflecting surfaces formed at the interior of the light conducting element. The light conductive elements are positioned adjacent assembly members having different light conducting characteristics to assemble the article of furniture. The light conducted through the light conductive elements in conjunction with the assembly members of the article of furniture create a unique and attractive visual effect.

14 Claims, 10 Drawing Figures

ELEMENT FOR CONDUCTING LIGHT TO AN OUTSIDE SURFACE OF FURNISHING ARTICLE

BACKGROUND OF THE INVENTION

1. Field of the Invention

This invention relates to means for directing light from the interior of an article of furniture or furnishing object to the exterior visible surface of the article of furniture or furnishing object, thereby creating an attractive visual effect.

2. Brief Description of Prior Art

It is well known to utilize external light sources such as spot lights and indirect lighting sources to create pleasing and attractive visual effects. These external light sources have been employed extensively to accent various artistic creations and to enhance the appearance of the decorative schemes of rooms, offices and the like.

Light sources have also been located in the interiors of a variety of different furnishing objects and articles to create an attractive external visual appearance. Thus it is apparent that light can measurably enhance the appearance and attraction of various objects and can be effectively utilized to create desirable visual effect in a decorative scheme.

SUMMARY OF THE INVENTION

It is the general object of the present invention to enhance the visual appearance of various relatively commonplace articles of furniture or furnishing objects, and to enhance the already pleasing effect produced by many unique types of articles by use of light conducting elements in the articles of furniture or the furnishing objects.

In accordance with the present invention, the light conductive elements are assembled in the article of furniture for bending or directing light from the interior of the article through the light conductive element to the exterior visible surface of the article. The light is deflected from the interior of the article to its exterior by means such as light reflecting surfaces formed on the light conductive elements. The article of furniture or furnishing object is assembled from various assembly members positioned adjacent the light conducting elements, with the assembly members having different light conducting characteristics than those of the light conducting elements. A source of light is provided at the interior of the article by means such as a light conductive hollow interior for conducting natural light or light from a lamp to the interior of the article. Color filter means selectively change the color of interior light which is bent to the exterior of the article, and thereby varying the color of the light emitted. The light conductive elements and the adjacent assembly members of different light conducting characteristics may be alternately positioned in sequence to form a significant portion of the article.

By the invention, the external appearance of many articles of furniture and furnishing objects can be significantly enhanced over the previously-considered, relatively ordinary appearance of these articles, or the already unique appearance of certain articles may be further accentuated.

The features which characterize the invention are defined in the annexed claims. A preferred embodiment of the invention itself, as to its organization and method of operation, together with further objects and advantages, will best be understood by reference to the following brief description of the drawings and detailed description of the preferred embodiments.

DETAILED DESCRIPTION OF PREFERRED EMBODIMENTS

Figure 1:
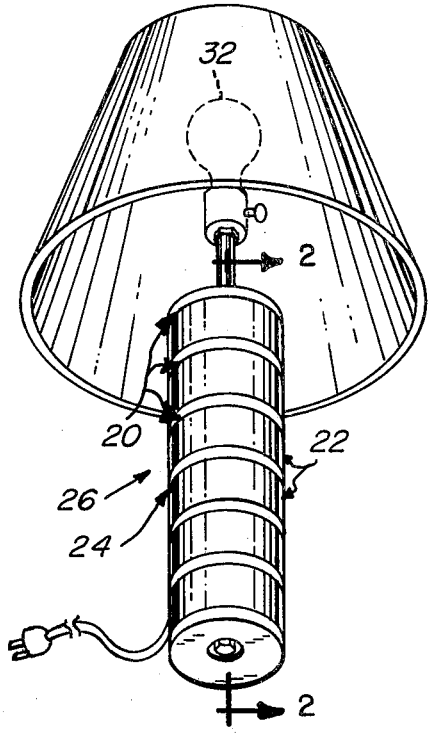
FIG. 1 is a perspective view of a lamp in which the present invention is employed.

General organization of the present invention can be understood by reference to FIGS. 1, 2, 4 and 5 wherein at least one light conductive element 20 is positioned adjacent to at least one assembly member 22 having different light conducting characteristics than the light conducting characteristics of the light conducting element 20, in an article of furniture such as a lamp 26. The plurality of elements 20 and members 22 are positioned adjacent one another in an alternating sequence to define a portion of the article of furniture such as a base 24 of the lamp 26. An exterior surface 28 of the light conductive elements 20 is contiguous with an exterior surface 30 of the members 22 and cooperates therewith to define an outside visible surface of the lamp base 24. A source of light at the interior of the lamp base is provided by the construction of the light conductive elements 20 and members 22 whereby light may be conducted to the interior of the lamp base 26, for example from a bulb 32 of the lamp 24, or in other embodiments from natural lighting. This interior light is represented schematically at 34. Means, such as an interior light reflecting surface 36 deflects or directs, bends the light 34 through the elements 20 to their exterior surfaces 28, where the light leaves the outside visible surface of the lamp base 24 at the light conductive elements, the exiting light being identified schematically at 38. Since the assembly members 22 have different light conducting characteristics than the light conductive elements 20, the outside visible surface of the lamp base 24 takes on a distinctive and attractive appearance.

It should be understood that the outside visible surface of the article of furniture, furnishing object or the like in which the light conductive elements are employed need not be of any specific configuration or geometric design, and that the invention can be applied in a wide variety of geometric designs and configurations and articles.

Figure 4:
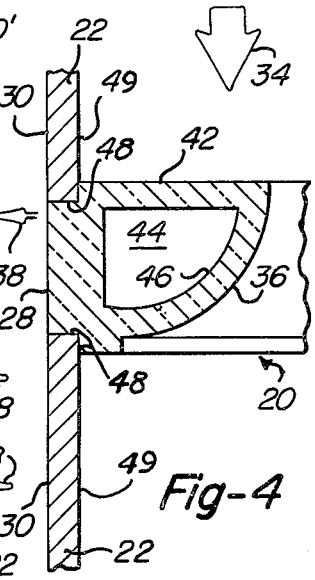
FIG. 4 is an enlarged portion of FIG. 2 with certain elements removed for clarity and with certain elements added to the light conductive element to illustrate an alternative embodiment of the light conductive element.
Figure 3:
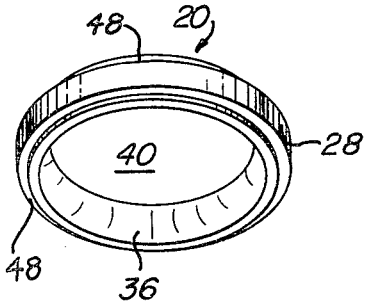
FIG. 3 is a perspective view of a light conductive element shown in FIGS. 1 and 2 and comprising one embodiment of the present invention.

The light conducting elements 20, shown in FIGS. 3 and 4, are of closed geometric figures, preferably circular in shape, although any shape or configuration may be employed as is desired. The exterior surface 28 of each light conducting element 20 is integrated into and comprises a part of the exterior visible surface of the furnishing article. The interior surface 36 is spaced interiorally or radially inwardly from the exterior surface 28 and defines a circular center opening 40 through the light conducting element 20 in which the interior light 34 is present, although a source of interior light can be achieved at the interior of the furniture article by means other than the openings 40. An upper or light intercepting surface 42 extends horizontally and generally perpendicularly from the exterior surface 28 for the purpose of intersecting the interior light 34. Light intersected by the surface 42 is at least partially reflected by the surface 36 and conducted out of the element 20 transversely at the surface 28. The reflecting surface 36 is preferably arcuate in shape to deflect a large portion of the light which strikes the upper surface 42 at a variety of different angles and direct it out through the exterior surface 28, since the interior light at 34 is not necessarily present in an axially aligned beam but is typically dispersed about the interior of the article in a variety of angled paths.

The light conducting element 20 may be formed with a hollow center opening or core 44, as shown in FIG. 4, or the element 20 may be of solid construction, as shown in FIG. 3. Shown in FIG. 4, an additional arcuate light reflecting surface 46 of the hollow core 44 also deflects at least part of the light striking the surface 42 of the element 20 to the exterior surface 28. A variety of other light reflecting surfaces and directing means may be provided in the interior or hollow core 44 at each element 20.

Figure 5:
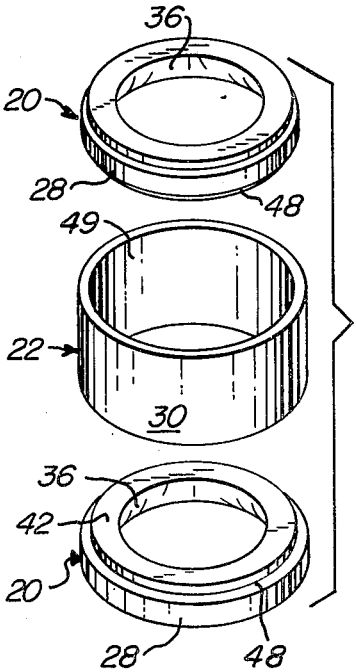
FIG. 5 is an exploded perspective view of light conductive elements and one of the assembly members which are shown in FIGS. 1, 2 and 4.

The exterior surface 28 of the light conductive element 20 is positioned in a desired relationship with the assembly members 22 by shoulders 48, shown best in FIGS. 4 and 5. The shoulders 48 are integrally formed on the light conductive element and abut an interior surface 49 of the assembly members 22, contacting the light conductive element 20 on opposite axial sides. The interior surface 49 defines a center opening through each assembly member 22.

Figure 2:
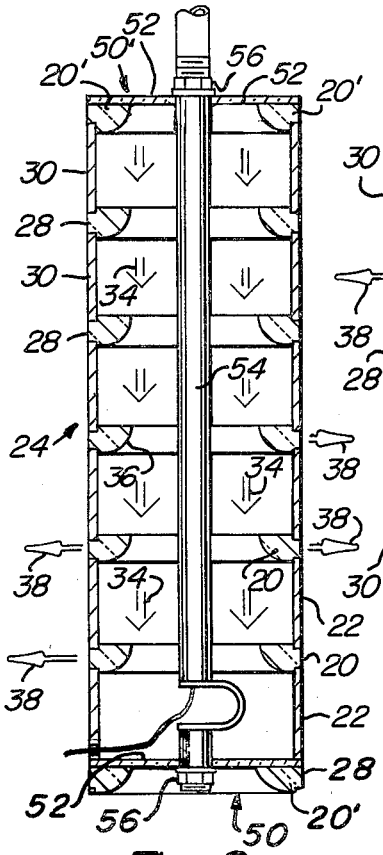
FIG. 2 is a vertical section view taken substantially in the plane of line 2—2 of FIG. 1.

Light conductive end elements 50 and 50', illustrated in FIG. 2, are attached at each end of the alternating sequence of elements 20 and members 22 in the lamp base 24. Each end element is comprised of a light conducting element 20' to which a disc member 52 is attached to the surface 42 (FIG. 4). The light conductive element 20' does not include the shoulders 48 adjacent the surface 42 of a element 20.

The light conductive elements 20 and the end elements 50 and 50' are preferably constructed of light transparent material such as clear plastic. By using clear material, the exit light at 38 is the same color as the interior light at 34. The members 22 are preferably formed of materials of translucent or opaque characteristics, or a combination of materials having different light conducting characteristics different than those of the elements 20.

Portions of furnishing articles employing the light conductive elements 20 and the members 22 may be assembled with a variety of different conventional apparatus. In the lamp base 24 illustrated in FIGS. 1 and 2, a center rod 54 extends between the bottom end element 50 to the top end element 50'. The members 22 and elements 20 are stacked in alternating sequence from the bottom end element 50 to the top end element 50', and fastening means such as nuts 56 are threaded onto the center rod 54 to hold the elements 20 and members 22 in an assembled relationship.

A fuller appreciation of the function of the present invention may be obtained by reference to FIGS. 1 and 2. When the bulb 32 of the lamp 26 is energized, a portion of the light emitted from the bulb is conducted through the top end element 50' and admitted into the hollow interior of the lamp base 24 to become the source of interior light 34. Upon striking the reflecting surfaces 36 (and surfaces 46 if used) of the light conductive elements 20, the interior light is bent to the exterior surface 28 of the elements 20. Due to the different characteristics of the elements 20 and end elements as compared to the light conducting characteristics of the assembly members 22, a contrasting and different visual appearance occurs between elements 20 and members 22 at the outside visible surface of the article.

Figure 6:
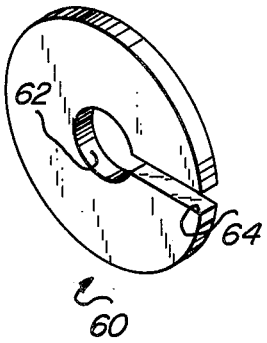
FIG. 6 is a perspective view for a color filter means for a light source which is used in conjunction with the invention in one embodiment thereof.
Figure 7:
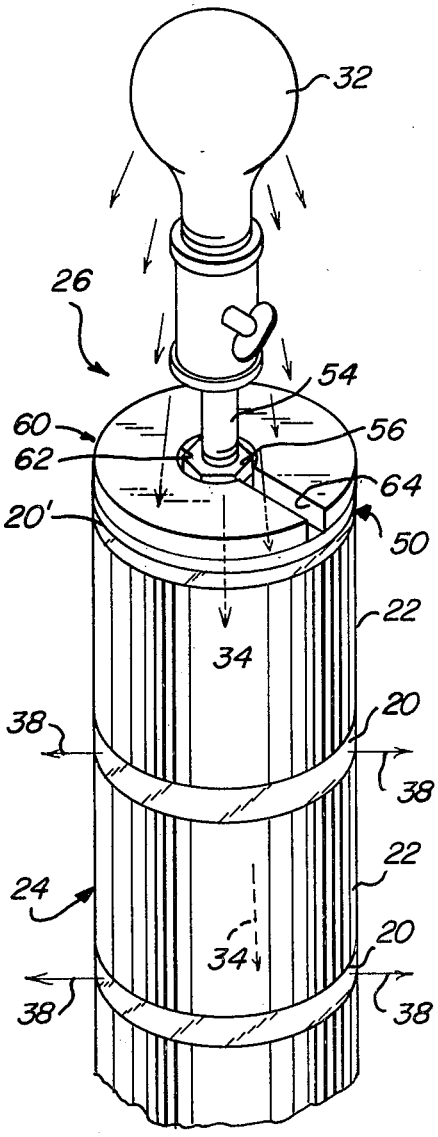
FIG. 7 is a perspective view of a lamp similar to that of FIG. 1 illustrating use of the color filter means of FIG. 6 in conjunction therewith.

Changing the color of the light at the interior of the article changes the visual appearance at the outside visible surface. Varying the color of the interior light may be easily and selectively achieved by means of a color filter member 60 shown in FIG. 6. The filter member 60 is formed of light conductive material which filters the light passing therethrough to achieve the desired color of interior light. The color filter member 60 is placed in the path of the interior light source, for example, adjacent to the top end element 50' through which light flows to the interior of the article, as is shown in FIG. 7. The color filter member 60 has a center opening 62 and a slot 64 leading therefrom to its outside surface for the purpose of easily sliding over and receiving the center rod 54 and nut 56 of the lamp 26 shown in FIG. 7. Positioned in this manner, light from the bulb 32 passes first through the colored filter member 60 and then through the light conductive top end member 50' to the interior of the lamp base 26. The colored interior light 34 is then bent and exists from the outside visible surface of the lamp base 24 at the light conductive element 20 in the manner previously described.

Figure 8:
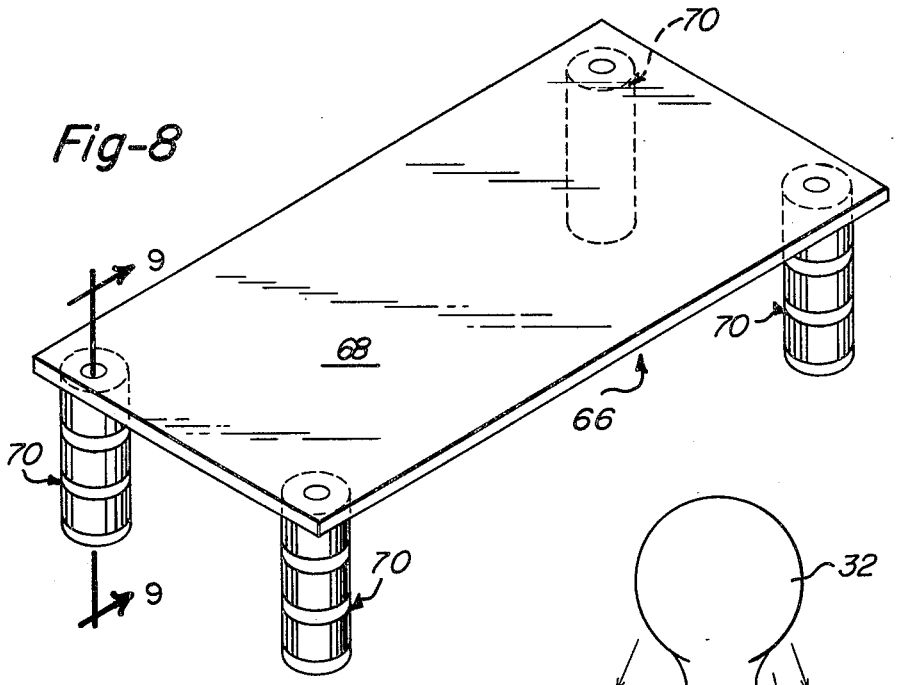
FIG. 8 is a perspective view of a table to which the present invention may also be applied.
Figure 9:
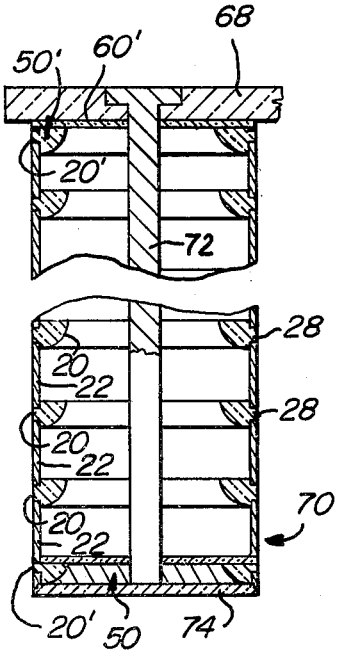
FIG. 9 is a vertical section view taken substantially in the plane of line 9—9 of FIG. 8.

An example of the use of the present invention in conjunction with a natural source of light for producing a desired visual effect is illustrated in FIGS. 8 and 9. A table 66 having a light conductive top 68 is provided with four legs 70. Each of the legs, as is shown best in FIG. 9, is comprised of an alternating sequence of light conductive elements 20 and assembly members 22 with light conductive end elements 50 and 50' attached at opposite ends of the alternating sequence. A disc-like colored filter member 60' can be attached intermediate the table top 68 and the upper end element 50'. A center rod 72 and plate 74, which is welded or otherwise attached to the rod 72, hold the components of the leg 70 in the assembled relation, in a manner similar to that described previously.

Natural light conducted through the table top 68 reaches the interior of the table legs 70 by first passing through the colored filter member 60' and then the top end element 50'. The light at the interior of the table legs 70 is deflected by the reflecting surfaces of the light conducting elements 20 and exits the table leg 70 at the exterior surfaces 28 of the elements 20 to secure the visual effect, as previously described.

Figure 10:
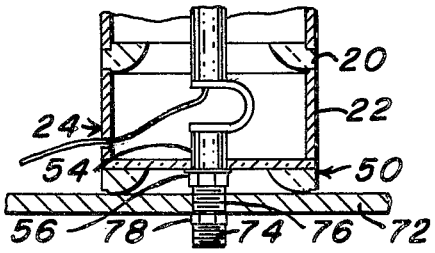
FIG. 10 is a partial view of a portion of FIG. 2 illustrating an alternative arrangement of elements of the invention.

In certain installations such as in commercial or public areas and in moving vehicles such as boats or the like, it is desirable to securely mount the article of furniture to the object upon which it rests. In FIG. 10, there is illustrated one arrangement for securely mounting the lamp base 24 to a horizontal table top 72 or other article supporting the lamp. In this arrangement a center rod extension member 74 is attached to the center rod 54 and the extension member 74 extends below the support surfaces of the bottom end member 50. An opening 76 is formed in the table top 72 to receive the extension member 74. Fastening means such as a nut 78 is attached to the end of extension member 74 below the table top 72 to axially force the bottom end member 50 of the lamp base 24 into substantial and rigid engagement with the table top. By this arrangement, the lamp is prevented from tipping or falling should the table top 72 tilt or move. This arrangement further prevents the lamp from being easily removed from the position to which it is attached. It should be apparent that the arrangement illustrated in FIG. 10 can be employed with articles of furniture other than lamps if desired.

It should be apparent that a unique and distinctive appearance in a variety of different articles of furniture or the like can be secured by use of the present invention. The visual contrast between the light emitted from the light conductive elements and the different visual characteristics of the assembly members adjacent the light conductive elements changes the relatively ordinary exterior visual appearance of a variety of common articles to an attractive exterior visual appearance.

Although the present invention has been described with a certain degree of particularity, it should be understood that the present disclosure has been made by way of example and that changes in details of structure may be made without departing from the spirit and scope of the invention.

I claim as my invention:

1. An article of furniture or the like having an outside visible surface wherein at least a portion of said visible surface comprises:

at least one light conductive element having an exterior surface defining a portion of said visible surface, and at least one member having light conducting characteristics different from the light conducting elements, each member being positioned adjacent a light conductive element along said visible surface, said light conductive elements and said members cooperating to define at least part of a hollow interior portion of said article of furniture, said hollow interior portion being adapted to receive light therein and;

said article of furniture further comprising:

bending means associated with said light conductive means for bending light traveling within the hollow interior from a path generally in alignment with said visible surface to a path generally transverse to said visible surface to create illuminated areas defined by said light conducting elements separated by differently illuminated areas defined by said members.

2. The article defined in claim 1 wherein said bending means comprises a light reflecting surface of each light conductive element adapted to bend rays of light in said hollow interior to pass outwardly through said light conductive element.

3. The article defined in claim 2 wherein said light reflecting surface of each light conductive element extends inwardly away from said exterior surface of the light conductive element and projects into said hollow interior to a greater extent than said adjacent members project.

4. The article defined in claim 3 wherein said light reflecting surface is arcuate in configuration.

5. The article defined in claim 1 further including means on one of said light conductive element and said member for positioning said light conductive element relative to said member.

6. The article defined in claim 5 wherein said positioning means consists of an integrally formed shoulder.

7. The article defined in claim 2 further including means for supplying light into said hollow interior with a substantial portion of the light flowing in a path generally in alignment with the visible surface.

8. The article defined in claim 7 wherein said means for supplying light comprises a transparent end element of said article.

9. The article defined in claim 8 further including a colored filter element adapted to overlie said end element whereby light passing through the end element will take the color of said colored filter element.

10. An article of furniture having an outside visible surface of geometric configuration, said visible surface comprising:

at least one light conductive element having an exterior surface defining a portion of said visible surface, and an interior surface spaced interiorly from the exterior surface, the interior surface including an arcuately shaped portion angled to reflect light from the arcuate portion through said element and out through the exterior surface; and at least one member having light conducting characteristics significantly different than those of said light conductive element, each member being positioned adjacent an element, each member having an exterior surface defining a portion of said visible surface, each member also having an interior surface spaced interiorly from the exterior surface, the interior surface of said member extending inwardly to a lesser extent than the inward extent of the arcuate portion of the interior surface of each said element;

the interior surfaces of said elements and said members cooperating to define at least part of a hollow interior of said article, said hollow interior adapted to conduct light therein, the arcuate portion of the interior surfaces of each said element projecting into the hollow interior past the interior surfaces of said members to allow light in the hollow interior to intersect the arcuate portions without obstruction by the interior surfaces of said members.

11. An article as defined in claim 10 wherein each said element and said member is formed as a closed geometric figure defining an open hollow center.

12. An article as defined in claim 11, further comprising means for admitting light into the hollow interior of said article.

13. An article as defined in claim 12 further comprising filter means for coloring the light within the hollow interior admitted by said admitting means.

14. The invention defined in claim 12 wherein said article comprises a lamp base.

* * * * *